United States Patent [19]

Takai et al.

[11] 4,144,700

[45] Mar. 20, 1979

[54] FALSE TWISTING APPARATUS

[75] Inventors: Isao Takai, Ishikawaken; Noboru Shindo, Shigaken, both of Japan

[73] Assignee: Murata Kikai Kabushiki Kaisha, Japan

[21] Appl. No.: 859,393

[22] Filed: Dec. 12, 1977

[30] Foreign Application Priority Data

| | | | |
|---|---|---|---|
| Dec. 14, 1976 | [JP] | Japan | 51-150634 |
| Dec. 14, 1976 | [JP] | Japan | 51-168142[U] |
| Dec. 14, 1976 | [JP] | Japan | 51-168143[U] |
| Dec. 14, 1976 | [JP] | Japan | 51-168147[U] |

[51] Int. Cl.[2] ..... D02G 1/06; D01H 7/92

[52] U.S. Cl. ..... 57/264; 57/336; 57/346; 57/1 R; 73/160

[58] Field of Search ..... 57/77.4, 77.45, 34 R, 57/157 R, 157 TS

[56] References Cited

U.S. PATENT DOCUMENTS

| | | | |
|---|---|---|---|
| 3,659,408 | 5/1972 | Burr | 57/77.4 |
| 4,012,897 | 3/1977 | Ougura | 57/77.4 |
| 4,047,373 | 9/1977 | Takai | 57/77.4 |

FOREIGN PATENT DOCUMENTS

| | | | |
|---|---|---|---|
| 4914 | 7/1902 | Denmark | 57/77.4 |
| 138554 | 6/1900 | Fed. Rep. of Germany | 57/77.4 |
| 139003 | 1/1903 | Fed. Rep. of Germany | 57/77.4 |

*Primary Examiner*—Donald Watkins

*Attorney, Agent, or Firm*—Whittemore, Hulbert & Belknap

[57] ABSTRACT

A false twisting apparatus comprising two endless belts crossing each other and running in opposite directions at the crossing point is disclosed, in which a yarn running through the crossing point is nipped by both the belts at the crossing point and is false-twisted by a frictional effect caused between the two belts. In this false twisting apparatus, the angle of crossing of the two endless belt is set in advance, and the apparatus may include means for detecting minute variations of this predetermined crossing angle and correcting such minute variations.

19 Claims, 15 Drawing Figures

FALSE TWISTING APPARATUS

BACKGROUND OF THE INVENTION (1) Field of the Invention

The present invention relates to a false twisting apparatus for imparting false twists to yarns by using two running belts crossing each other.

(2) Description of the Prior Art

False twisting spindles have heretofore been used predominantly as the false twister. False twisting apparatus of this type, however, involve various problems as regards the yarn running speed, generation of fluffs and occurrence of yarn breakages. In addition to false twisters of the spindle type, there have recently been developed frictional type false twisters. Such newly developed false twisters comprise a plurality of belts crossing one another, and the belts are arranged so that they run in opposite directions at the crossing point. In a false twister of this type, a yarn is guided to this crossing point by means of a guide, and the yarn is nipped between the belts at the crossing point and is false-twisted by friction.

SUMMARY OF THE INVENTION

It is a primary object of the present invention to provide a false twisting apparatus comprising two endless belts, in which both the left and right belts are simultaneously set at the same angle.

In a false twisting apparatus of the type comprising two belts, the operation of adjusting brackets for attachment of the two belts independently is very troublesome, and by such operation, it is very difficult to precisely set the angles of both the belts and minute deviations are readily caused. Such minute deviations of the set angles of the belts result in not only changes of the yarn passage but also changes of the twist number. For example, when a 150-d polyester yarn is processed at a rate of 800 m/min, a change of the belt angle $\theta$ by 1° results in a change of the twist number by 26 twists per meter. When the set angle of one belt is different from the set angle of the other belt, the yarn passage is deflected to the left or right and no sufficient twist number can be obtained.

A secondary object of the present invention is to provide a false twister of the above-mentioned type including a twist number controlling device in which the twist number of a yarn to be false-twisted can be adjusted by changing the crossing angle of two belts.

The twist number given to a yarn is reduced below the twist number theoretically calculated from the set angle because of such variation factors as elongation and abrasion of the belts. Of course, it is possible to detect variations of the twist number by a known tension or twist number detector and correct the variations by feedback control of a motor for driving the belts. However, this method is disadvantageous from the economical viewpoint because one driving motor is necessary for every spindle. Moreover, this control method cannot be regarded as an effective twist number control method utilizing the characteristics of the above-mentioned false twister of the type including two belts.

In the present invention, one characteristic of the above false twister that the twist number can be set and controlled by adjustment of the set angle of the belts is noted, and control of the twist number is performed for every spindle independently by detecting the twist number by detection of the tension and operating an angle changing device based on the detected value of the twist number.

Another object of the present invention is to provide a false twister of the above-mentioned type including a member for displaying the belt angle $\theta$ in the magnified state so as to set precisely the angle $\theta$ between the two belts, in which the belt angle $\theta$ can be set and adjusted even by units of minutes.

According to the present invention, two crossed endless belts can be set and adjusted at a desirable belt angle $\theta$ precisely, whereby a yarn can be uniformly false-twisted.

DETAILED DESCRIPTION OF THE PREFERRED EMBODIMENTS

The present invention will now be described in detail by reference to embodiments illustrated in the accompanying drawings.

Figure 1:
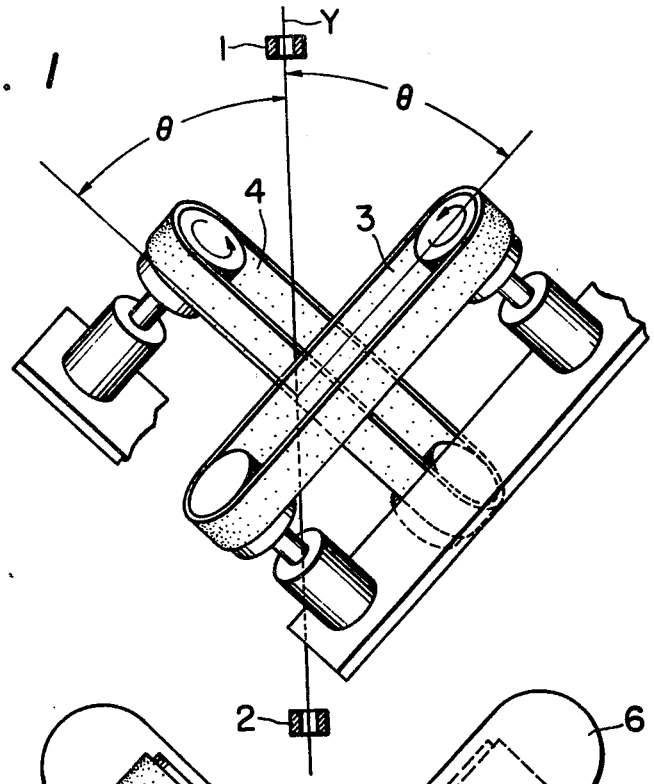
FIG. 1 is a perspective view illustrating a false twisting apparatus comprising two endless belts.

FIG. 1 is a perspective view illustrating a false twisting apparatus comprising two crossed endless belts. Referring to FIG. 1, two endless belts 3 and 4 are laid out so that they are inclined at an angle $\theta$ with respect to the running direction of a yarn Y running between guides 1 and 2 and they run is opposite directions at the point of contact with the yarn Y. The yarn Y is nipped and false-twisted between the endless belts 3 and 4 at this contact point.

Figure 2:
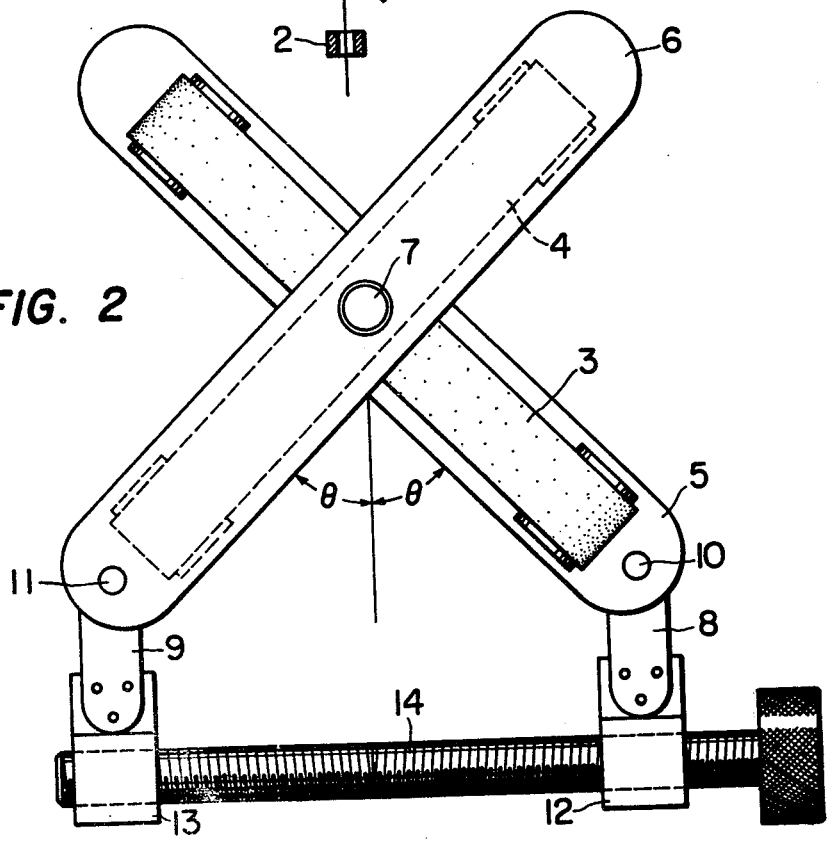
FIG. 2 is a front view illustrating a first embodiment in which both the left and right belts are simultaneously set at the same angle according to the present invention.

FIG. 2 illustrates a first embodiment of the present invention in which the left and right belts can be simultaneously set at the same angle. Referring to FIG. 2, brackets 5 and 6 rotatably supporting belts 3 and 4 are supported on shafts 7 so that they can swing with the shafts 7 being as the center. The shafts 7 are fixed at one end to the back faces of the brackets 5 and 6 on the sides opposite to the belts, and the other ends of the shafts 7 are rotatably supported on a machine stand (not shown). Levers 8 and 9 are supported through shafts 10 and 11 at one end by the brackets 5 and 6, respectively. The other ends of the levers 8 and 9 are fixed to nuts 12 and 13 screwed on a screw shaft 14. Directions of threads formed on the left and right sides of the screw shaft 14 are opposite to each other, but the screw pitch is the same on both the sides. Accordingly, if the screw shaft 14 is turned, the nuts 12 and 13 are advanced to the center simultaneously at the same pitch or they are advanced outwardly of the screw shaft 14 simultaneously at the same pitch.

Accordingly, if the screw shaft 14 is turned, with the advance of the nuts 12 and 13 the angles $\theta$ of the brackets 5 and 6 supported through the levers 8 and 9 can be freely adjusted simultaneously with the shaft 7 being as the center. If the relation between the rotation number of the screw shaft and the angle $\theta$ is tabulated in advance, the set angle $\theta$ can be changed promptly and precisely.

Figure 3:
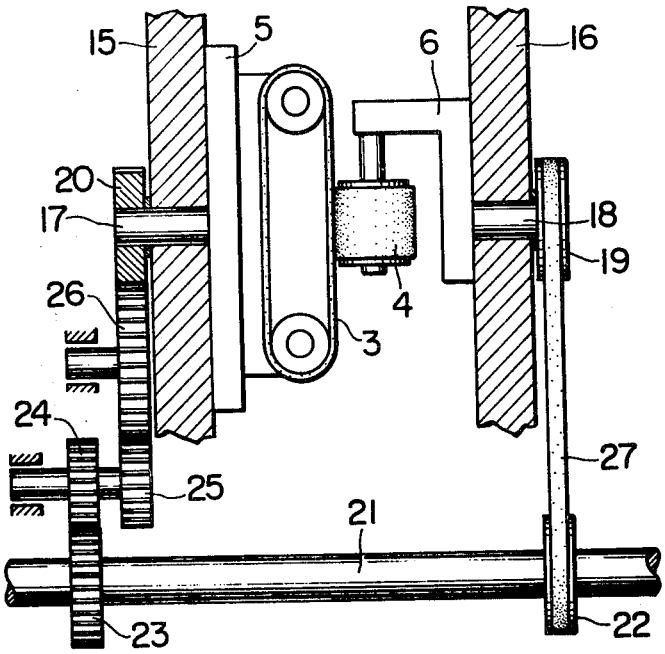
FIG. 3 is a side view illustrating a second embodiment of the present invention.

FIG. 3 is a view illustrating a second embodiment in which the left and right belts are set according to the present invention. Referring to FIG. 3, brackets 5 and 6 supporting belts 3 and 4 are supported through shafts 17 and 18 on fixed plates 15 and 16 of the machine stand, and a pulley 19 or sprocket is mounted on the shaft 18 and a gear 20 is keyed and fixed to the other shaft 17. A line shaft 21 is disposed below the fixed plates 15 and 16, and a pulley 22 or sprocket is fixed to this shaft 21 at a position facing the pulley 19 and a gear 23 is fixed to the shaft 21 at a position facing the gear 20. Intermediate gears 24, 25 and 26 are supported between the gears 20 and 23 and they are arranged so that the rotation angles of the gears 20 and 23 are the same as the rotation angle of the line shaft 21 though the rotation directions of the gear 20 and 23 are opposite to each other. A timing belt 27 is laid out between the pulleys 19 and 22. When sprockets are used instead of the pulleys, a chain is laid out instead of the belt 27.

Accordingly, if the line shaft 21 is turned at a certain angle, the bracket 6 is turned at the same direction as of the line shaft 21 through the pulley 22, timing belt 27 and pulley 19, while the other bracket 5 is turned at the same angle as that of the line shaft 21 but in a direction opposite to the rotation direction of the line shaft 21 through the gears, whereby the crossing angles of the belts 3 and 4 can be simultaneously changed.

Figure 4:
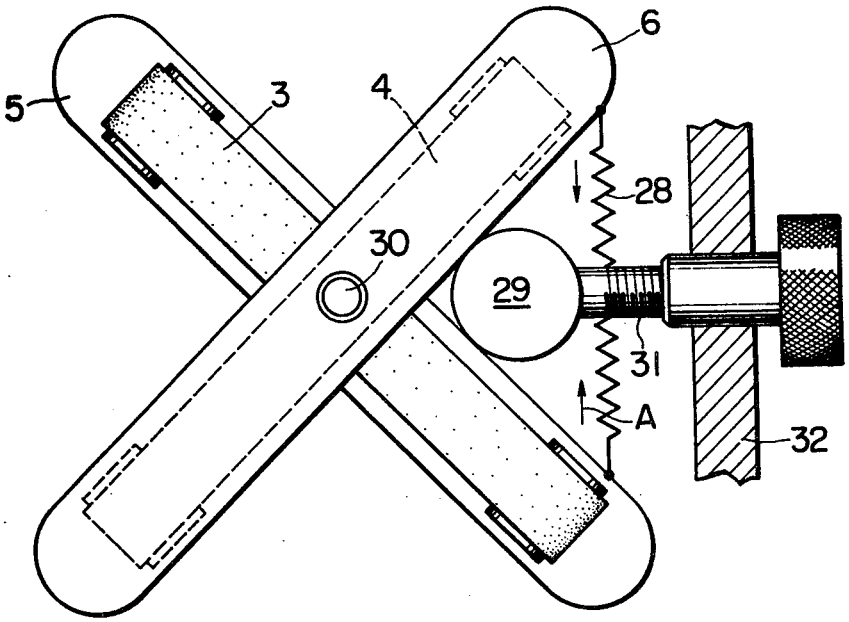
FIG. 4 is a front view illustrating a third embodiment of the present invention.

Referring to FIG. 4 illustrating a third embodiment of the present invention, a spring 28 is fixed between brackets 5 and 6 supporting rotary belts 3 and 4 to impart an urging force in a direction indicated by arrow A, and a ball or cylindrical member 29 is pressed to the side faces of both the brackets 5 and 6. A screw rod 31 is screwed and supported onto a fixed plate 32 to press the ball or cylindrical member 29 in a direction of an axial center 30 of the brackets 5 and 6.

Accordingly, if the rod 31 is rotated, the ball or cylindrical member 29 fixed to the top end of the rod 31 is moved to the right or left by predetermined pitches, and at this point, both brackets 5 and 6 always pressed to the ball or cylindrical member 29 are opened or closed depending on the quantity of the movement of the rod 31 and the rotation angles of the respective brackets 5 and 6 are always the same.

Figure 5:
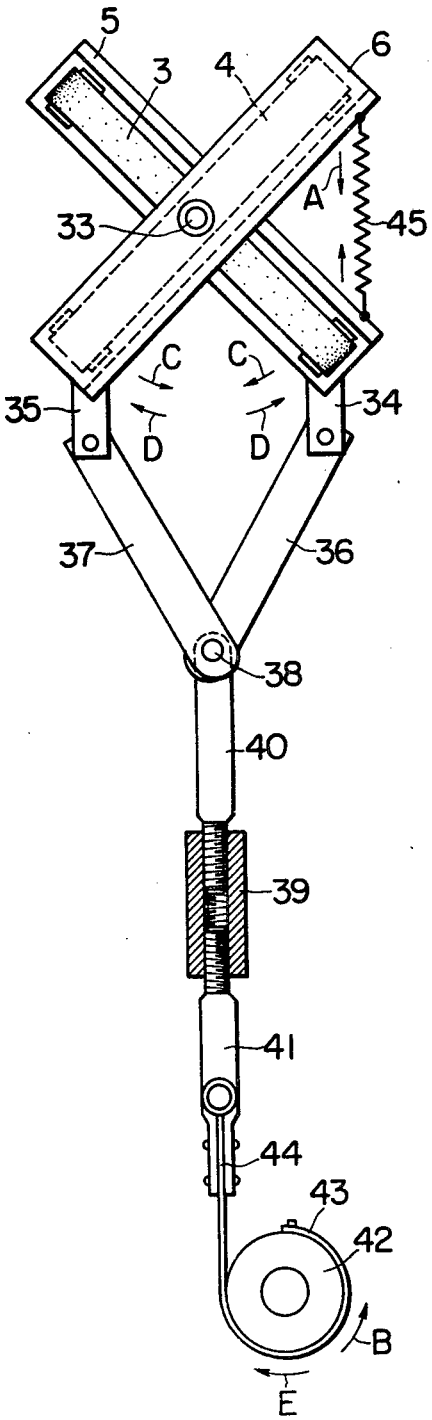
FIG. 5 is a front view illustrating a fourth embodiment of the present invention.

Referring to FIG. 5 illustrating a fourth embodiment of the present invention, brackets 5 and 6 supporting endless belts 3 and 4 are supported at the back faces thereof on the machine stand through shafts 33. Levers 34 and 35 are supported on ends of the brackets 5 and 6, respectively and these levers 34 and 35 are rotatably connected to other levers 36 and 37 at one end thereof. The other ends of the levers 36 and 37 are rotatably connected to a shaft 38. One end of a rod 40 connected to a turnbuckle 39 is supported on the shaft 38. On the side opposite to the rod 40, another rod 41 is fixed to the shaft 38 through the turnbuckle 39, and to the other end of the rod 41 is fixed one end 44 of a belt 43 wound and fixed onto a line shaft 42. A spring 45 is fixed between the brackets 5 and 6 to always impart an urging force in a direction indicated by arrow A.

Accordingly, if it is desired to set the angles of the brackets 5 and 6 in each spindle independently, by rotating the turnbuckle 39 disposed for each spindle, it is made possible to simultaneously turn the brackets 5 and 6 at the same predetermined angle through the rod 40, levers 36 and 37 and levers 34 and 35. If it is desired to set the angles of the brackets 5 and 6 simultaneously in all the spindles, by rotating the line shaft 42 in a direction indicated by arrow B, the brackets 5 and 6 can be simultaneously rotated in directions indicated by arrows C against the urging force of the spring through the turnbuckle and levers in each spindle. When it is desired to turn the brackets 5 and 6 in directions indicated by arrows D, by returning the line shaft 42 in a direction indicated by arrow E, the brackets 5 and 6 can be simultaneously turned by the urging force of the spring.

As will be apparent from the foregoing embodiments, according to the present invention, both the brackets supporting belts can be simultaneously turned at the same angle, and therefore, the crossing angle of the belts can be set without any error and occurrence of undesirable phenomena such as changes of the yarn passage and twist number can be effectively prevented. Thus, the crossing angle of the belts can be adjusted by a very simple operation according to the present invention.

In the above-mentioned false twisting apparatus, the twist number can be changed by changing the crossing angle $\theta$ of belts 3 and 4. However, the twist number is greatly changed by a slight change of the above angle $\theta$. Accordingly, there is a risk that setting of the twisting member will be made insignificant by a slight error in setting the angle $\theta$.

A block gauge may be advantageously used for setting the crossing angle of the belts precisely. Embodiments of the block gauge that can be advantageously used in the present invention will now be described.

Figure 6:
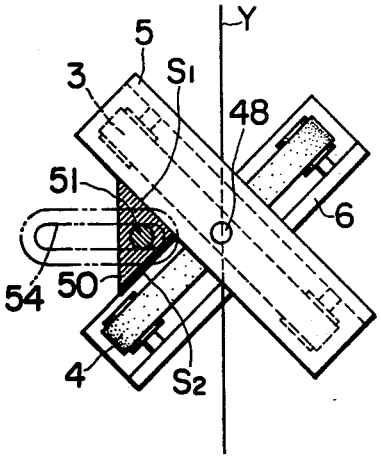
FIG. 6 is a front view illustrating a block gauge for setting the crossing angle of the left anf right belts, which is used in the present invention.
Figure 7:
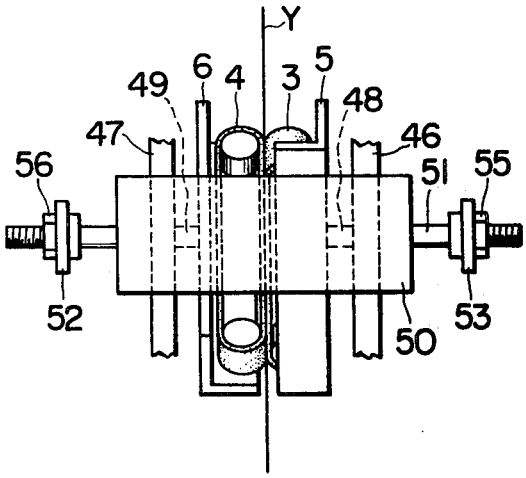
FIG. 7 is a side view of the block gauge shown in FIG. 6.

Referring to FIGS. 6 and 7, brackets 5 and 6 are supported on coaxial shafts 48 and 49 supported on machine frames 46 and 47, respectively, and false twisting belts 3 and 4 are supported through pulleys on these brackets 5 and 6, respectively. The shafts 48 and 49 are located at a point for nipping a yarn Y.

A block gauge 50 having a shape of a trigonal prism is supported by a shaft 51 parallel to the shafts 48 and 49. As shown in the drawing, one face S1 of the block gauge 50 is caused to bear against the bracket 6 and the other face S2 is caused to bear against the bracket 5, whereby the supporting shaft 51 is fixed and the crossing angle of the belts 3 and 4 can be set very precisely.

For example, the supporting shaft 51 may be inserted through long holes 54 formed to pierce through brackets 52 and 53 in a direction perpendicular to the running direction of the yarn Y and be fixed to the brackets 52 and 53 by nuts 55 and 56.

The twist number may be changed and set by exchanging the block gauge 50 with another block gauge. In this case, if block gauges differing in the set twist number are painted in different colors, a necessary block gauge can be discriminated at a glance and the operation can be remarkably facilitated.

Figure 8:
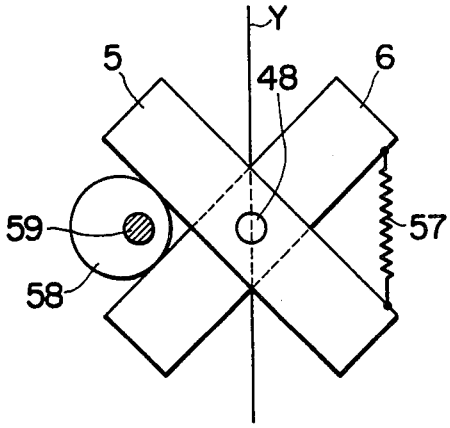
FIG. 8 is a front view showing another embodiment of the block gauge.

Another embodiment of the block gauge is illustrated in FIG. 8. Referring to FIG. 8, brackets 5 and 6 are urged by a tensile spring 57 so that they bear against a block gauge 58 having a shape of an eccentric column. When the block gauge 58 is rotated by turning a supporting shaft 59, the crossing angle of belts can be minutely adjusted.

Incidentally, if a number of false twisters are arranged in the long'udinal direction of the block gauge (for example, in the left-right direction in FIG. 7), the crossing angle of belts can be simultaneously set and arranged in all of these false twisters.

In the above-mentioned false twisting apparatus, the number of twists given to the yarn can be changed and adjusted by appropriately setting and adjusting the crossing belts. The crossing angle may be changed in apparatuses as shown in FIGS. 2 to 5. In the present invention, it is also possible to control the twist number independently for respective spindles by finding the twist number on the yarn by detecting the tension on the running yarn and controlling variations of the twist number by operating an angle-adjusting device. An embodiment of this device will now be described by reference to FIG. 9.

Figure 9:
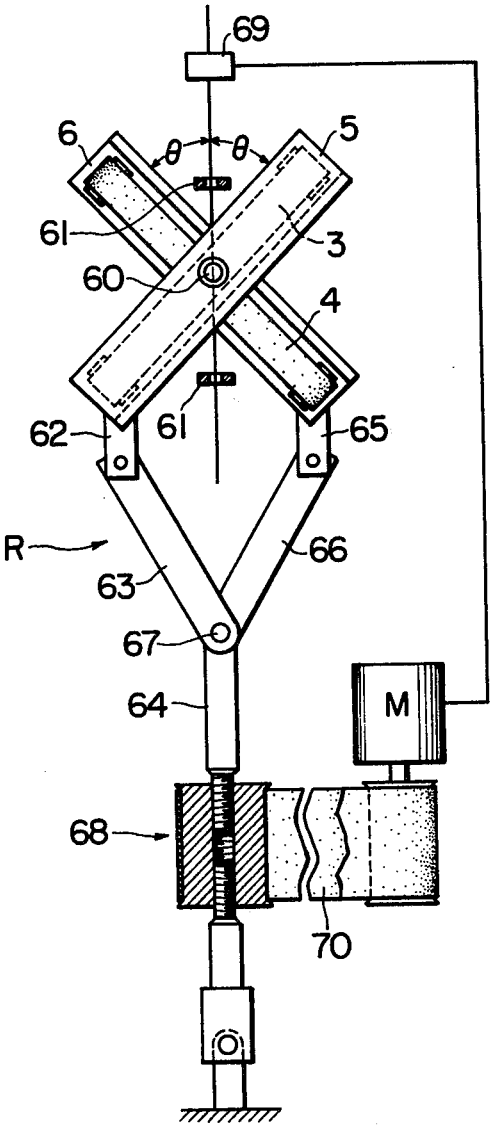
FIG. 9 is a structural view illustrating diagrammatically one embodiment of a twist number control device that is used in the present invention.

Referring to FIG. 9, brackets 5 and 6 supporting endless belts 3 and 4, respectively, are inclined at an angle $\theta$ in opposite directions with respect to the runnning direction of a yarn Y. The back surface of each bracket is supported on a shaft 60. The endless belts 3 and 4 are arranged so that they are driven and rotated by a driving mechanism (not shown) while they have pressing contact with each other in the central portions thereof. Reference numeral 61 represents a guide for the running yarn.

In this embodiment, a link mechanism including a turnbuckle is illustrated as the angle-adjusting device for changing the crossing angle of the brackets 5 and 6. More specifically, a lever 62 is pivoted on one end of the bracket 5 and a swinging lever 63 is connected to the lever 62. The other end of the swinging lever 63 is supported on the top end of a rod 64 through a shaft 67. Similarly, a lever 65 is pivoted on one end of the bracket 6, a swinging lever 66 is connected to the lever 65, and the other end of the swinging lever 66 is supported on the rod 64 through the shaft 67. Thus, a link mechanism R is constructed. The lower end of the rod 64 is connected to a turnbuckle 68 so that if the turnbuckle 68 is turned in a normal or reverse direction, the brackets 5 and 6 can be turned through the link mechanism R with the central shaft of the brackets 5 and 6 being as the center of turning and the crossing angle $\theta$ can be freely changed.

A yarn tension detector for detecting the number of twists given by the endless belts (the yarn tension is detected as a value substantially proportional to the twist number) or twist number detector 69 is disposed in the passage of the running yarn, and a value detected by the tension or twist number detector 69 is converted to an electric signal, the electric signal is fed back to a motor M for rotating the turnbuckle 68 and rotation of the motor M is transmitted to the turnbuckle 68 through a belt 70.

Accordingly, variations of the twist number in each spindle are detected by the tension or twist number detector 69, and if there is a difference between the detected value and the set value, the turnbuckle 68 is turned at a certain angle through the motor M, whereby the crossing angle $\theta$ of the brackets 5 and 6 supporting the endless belts 3 and 4 can be changed and adjusted through the link mechanism R. In the present embodiment, since the twist number depends on the crossing angle of the belts, the twist number can be adjusted by adjusting the crossing angle in the above-mentioned manner.

According to the present embodiment, since the twist number is adjusted and controlled by changing the crossing angle without changing the running speed of the belts for the respective spindles, it is unnecessary to provide an endless belt-driving motor for each spindle independently and the belts of all the spindles can be driven by one line shaft. Accordingly, the false twisting system can be remarkably compacted.

Since the control device is expensive, from the economical viewpoint, it is preferred to adopt an arrangement in which signals from the detectors of the respective spindles are scanned and compared with the set twist number.

As will be apparent from the foregoing illustration, a variation of the angle between the belts results in a great variation of the number of twists given to the yarn. Accordingly, it is necessary to set the crossing angle $\theta$ of the belts precisely. The above-mentioned false twisting apparatus of the present invention may further include a member for displaying the angle between the belts in a magnified scale.

Figure 10:
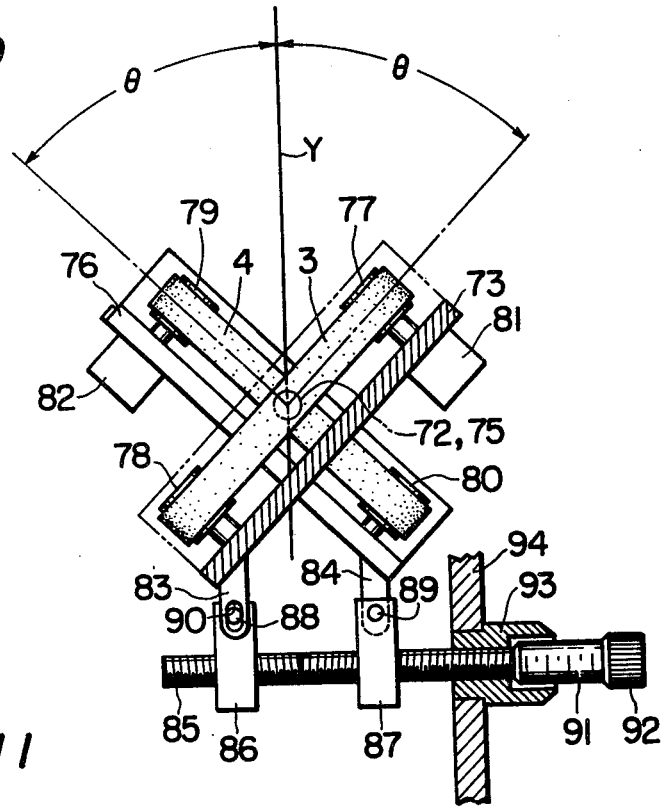
FIG. 10 is a partially sectional front view illustrating a scale-magnifying display device that is used in the present invention.
Figure 11:
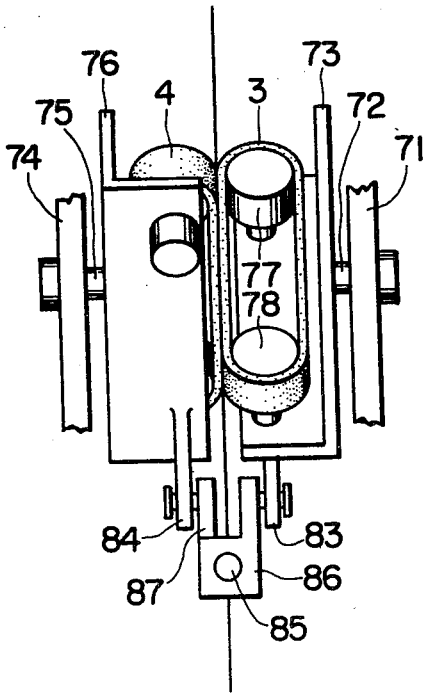
FIG. 11 is a side view of the device shown in FIG. 10.

Referring to FIGS. 10 and 11, an L-shaped bracket 73 is rotatably supported on a shaft 72 supported on a shaft 75 supported on a machine frame 74. Pulleys 77 and 78 for a belt 3 are supported on the bracket 73 and pulleys 79 and 80 for a belt 4 are supported on the bracket 76. Motors 81 and 82 are disposed to drive the pulleys 79 and 80. The shafts 72 and 75 are disposed concentrically with each other at a position gripping a yarn Y.

Figure 12:
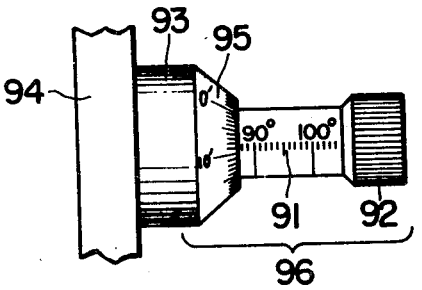
FIG. 12 is an enlarged view illustrating a micrometer portion in the device shown in FIG. 10.

Legs 83 and 84 on the lower ends of the brackets 73 and 76 are fitted through a long hole 90 to pins 88 and 89 of nuts 86 and 87 screwed on a normal-reverse screw 85. A dial 91 and a knob 92 are mounted on one end of the screw 85, and a nut 93 screwed on the screw 85 is fixed to a bracket 94. As shown in FIG. 12, an auxiliary scale 95 is scored on the outer periphery of the nut 93. A micro-meter 96 is constructed by these dial 91 and auxiliary dial 95. As in an ordinary micro-meter, the dials 91 and 95 may be dials indicating distances and the angle $\theta$ may be set from a conversion table of the dial and angle $\theta$. However, if the dial 91 and 95 are formed as dials indicating directly the angle $\theta$ in an enlarged scale and scales of units of minutes are scored on the auxiliary dial 95, the angle $\theta$ can be read very conveniently. In the present embodiment, the angle $\theta$ can be precisely adjusted in units of minutes by rotating the knob 92.

Figure 13:
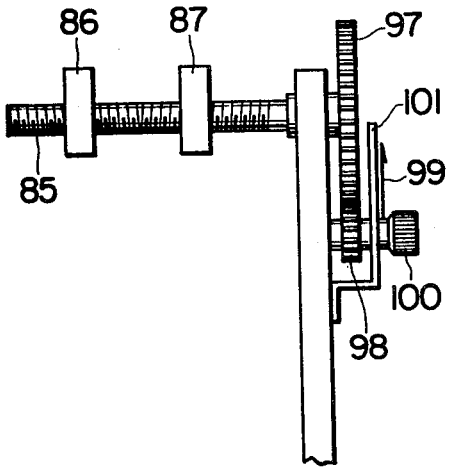
FIG. 13 is a front view showing another embodiment of the scale-magnifying display device.
Figure 14:
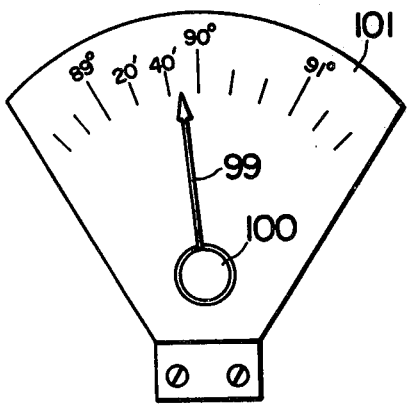
FIG. 14 is an enlarged front view showing a dial plate portion in the device shown in FIG. 13.

In an embodiment illustrated in FIG. 13, a gear 97 is fixed to one end of the screw 85 and a dial 99 and a knob 100 are integrally fixed to a gear 98 engaged with the gear 97. The angle $\theta$ is magnified by the gears 97 and 98, and scales of units of minutes are scored on a dial plate 101 as shown in FIG. 14.

The above-mentioned dial plate 101 or micro-meter 96 constitutes the member for displaying the crossing angle in a magnified scale. In the present invention, the member for displaying the crossing angle in a magnified scale is not limited to such dial plate and micro-meter specifically illustrated.

Figure 15:
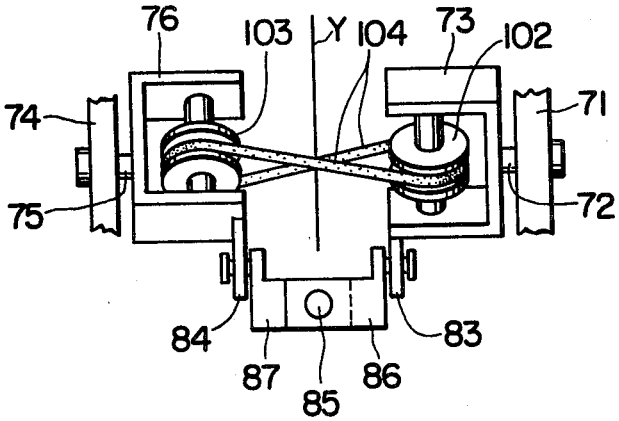
FIG. 15 is a side view illustrating still another embodiment of the scale-magnifying display device.

In the foregoing embodiment, two twisting belts are used. The present invention, however, may be applied to a false twisting apparatus in which one belt is used and this belt 104 is distorted by, for example, pulleys 102 and 103 as shown in FIG. 15 to form a nip point for nipping and twisting a yarn Y. In FIG. 15, members corresponding to the members in FIGS. 10 and 11 are indicated by the same reference numerals.

As will be apparent from the foregoing illustration, in the present embodiment, by provision of the member for displaying the belt and $\theta$ in a magnified scale, it is made possible to set the twist number very precisely.

What is claimed is:

1. A false twisting apparatus comprising two endless belts running in opposite directions and arranged so that the belts are crossed while the surfaces of the belts are brought into contact with each other and a running yarn is nipped and false-twisted by the belts at the crossing point of the belts, two brackets on which the endless belts are rotatably supported, respectively, a shaft supporting said brackets swingably, and a device for setting an angle between the two brackets respectively mounting an endless belt thereon whereby the brackets are turned simultaneously and with the same angle with respect to the running yarn centering around a crossing point of the belts.

2. A false twisting apparatus as set forth in claim 1 wherein said angle setting device comprises levers supported on one ends of said brackets, respectively, and said levers are fixed to nuts screwed on both the ends of a screw shaft, on both the sides of which normal and reverse screw threads are scored at the same pitch, respectively.

3. A false twisting apparatus as set forth in claim 1 wherein said angle setting device comprises shafts and fixed plates supporting said brackets, respectively, a pair of pulleys, one of which is fitted on one of said bracket-supporting shafts, a set of gears including a first gear fixed to the other bracket-supporting shaft and a line shaft disposed below the fixed plates and having a pulley fixed to one end thereof and another gear of said set of gears fixed to the other end thereof, and said set of gears are arranged so that they can be rotated in a direction to rotate said first gear in a direction opposite to the rotation direction of the pulley rotated by a timing belt at the same rotation angle as the rotation angle of said pulley.

4. A false twisting apparatus as set forth in claim 1 wherein said angle setting device comprises a spring laid out between the adjacent ends of the crossed brackets to urge the brackets in such a direction as will reduce the crossing angle, a ball or cylindrical member arranged to bear against the side faces of the crossed brackets and a screw rod for pressing said ball or cylindrical member in a direction of the axial center of the brackets.

5. A false twisting apparatus as set forth in claim 1 wherein said angle setting device comprises two first levers supported on one ends of the brackets, respectively, two second levers rotatably connected to said first levers, respectively, and a rod supporting the other ends of said two second levers coaxially and rotatably.

6. A false twisting apparatus as set forth in claim 5 wherein said angle setting device further includes a spring connecting the lever-supporting end of one bracket to one end of the other bracket, and a line shaft disposed to urge said rod supporting the second levers through a turnbuckle against said spring.

7. A false twisting apparatus as set forth in claim 5 wherein said angle setting device further includes a turnbuckle mounted on the other end of the lever-supporting rod and means for detecting the tension on the running yarn, converting the detected value to an electric signal and turning said turnbuckle through a motor in response to the electric signal, and wherein the crossing angle of the two endless belts is changed according to a change of the twist member.

8. A false twisting apparatus as set forth in claim 2 wherein said angle setting device further includes a micro-meter including a nut screwed on one end of the screw shaft supporting the brackets and a knob fixed to said one end of the screw shaft.

9. A false twisting apparatus as set forth in claim 2 wherein said angle setting device further includes a first gear fixed to one end of the screw shaft supporting the brackets, and a dial, a knob and a dial plate which are mounted on a second gear engaged with said first gear.

10. In a false twisting apparatus in which two endless belts are crossed while the surfaces of said two endless belts are brought into contact with each other and a yarn is nipped and false-twisted at the crossing point of said two endless belts, a method for setting the crossing angle of two brackets supporting rotatably said two endless belts comprising the step of adjusting the angle each bracket makes with the running direction of the yarn simultaneously and by the same amount.

11. In a false twisting apparatus comprising two endless belts arranged so that they are crossed while the surfaces of said endless belts are brought into contact with each other and a yarn is nipped and false-twisted at the crossing point of said two endless belts and brackets supporting rotatably said two endless belts, respectively and being supported on a shaft swingably with said shaft being as the center, a device for setting the crossing angle of the belts which comprises a block gauge having a shape of a trigonal prism, said block gauge being supported by a shaft parallel to the bracket-supporting shaft and including two faces bearing against the side faces of the crossed brackets, respectively.

12. In a false twisting apparatus comprising two endless belts arranged so that they are crossed while the surfaces of said endless belts are brought into contact with each other and a yarn is nipped and false-twisted at the crossing point of said two endless belts and brackets supporting rotatably said two endless belts, respectively and being supported on a shaft swingably with said shaft being as the center, a device for setting the crossing angle of the belts which comprises a block gauge having a shape of an eccentric column, said block gauge being supported by a shaft parallel to the bracket-supporting shaft and bearing against the side faces of the crossed brackets, respectively.

13. The method as set forth in claim 10 wherein the angle each bracket makes with the running direction of the yarn is adjusted by means of a block gauge.

14. The method as set forth in claim 10 and further including sensing the twist number of the yarn passing through the false twisting apparatus and automatically adjusting the angle the brackets make with the running direction of the yarn in accordance with the relation between the twist number of the yarn passing through the false twisting apparatus and a desired twist number.

15. False twisting apparatus including a pair of endless belts intersecting centrally being driven in opposite directions with respect to the running direction of yarn passing between the belts at their point of intersection characterized by means for simultaneously adjusting the angle each belt makes with the direction of running of the yarn equally.

16. Structure as set forth in claim 15 and further including a gauge block operably associated with the endless belts for simultaneously effecting the equal adjustment of the angle the belts make with the direction of running of the yarn.

17. Structure as set forth in claim 15 and further including means for sensing the twist number of yarn passing between the belts at their intersection and means for automatically adjusting the means for simultaneously and equally adjusting the angle each belt makes with the direction of running of the yarn in accordance with the sensed twist number to maintain a desired twist number.

18. A false twisting apparatus comprising a pair of pulleys each having an axis of generation, the axis of generation of which are crossed so as to make equal predetermined angles with respect to the direction of run of yarn passing between an endless belt passing over each of the pulleys and engaged between the pulleys and a belt passing over each of the pulleys and intersecting at a point between the pulleys.

19. Structure as set forth in claim 18 and further including means for simultaneously adjusting the angle each of the axis of the pulleys makes with the direction of the run of the yarn equally.

* * * * *